United States Patent [19]

Dobberstein

[11] Patent Number: 4,549,130

[45] Date of Patent: Oct. 22, 1985

[54] LOW LEAKAGE TRANSFORMERS FOR EFFICIENT LINE ISOLATION IN VHF SWITCHING POWER SUPPLIES

[75] Inventor: Edward A. Dobberstein, Boca Raton, Fla.

[73] Assignee: International Business Machines Corporation, Armonk, N.Y.

[21] Appl. No.: 513,205

[22] Filed: Jul. 12, 1983

[51] Int. Cl.[4] ..... H01F 27/38

[52] U.S. Cl. ..... 323/308; 336/82; 336/170; 336/188; 363/126

[58] Field of Search ..... 323/307, 308, 309; 336/82, 170, 188, 208; 363/126

[56] References Cited

U.S. PATENT DOCUMENTS

| | | | |
|---|---|---|---|
| 2,181,899 | 12/1939 | Kennedy | 336/82 |
| 2,608,610 | 8/1952 | Thulin | 336/208 |
| 2,659,845 | 11/1953 | Calvert | 217/206 |
| 3,958,328 | 5/1976 | Lee | 29/605 |
| 3,965,408 | 6/1976 | Higuchi et al. | 323/309 |

FOREIGN PATENT DOCUMENTS

| | | | |
|---|---|---|---|
| 1161400 | 8/1969 | Fed. Rep. of Germany | 336/208 |

OTHER PUBLICATIONS

IBM TDB, vol. 21, No. 5, 10/78, to D. J. Clark, "Transformer Bobbin with Extended Interwinding Creepage Path", p. 1920.

IBM TDB, vol. 22, No. 9, 2/80, to J. K. Radcliffe, "Flat Winding Transformer", pp. 4009–4012.

Feng, et al., "Very-High Frequency DC-to-DC Conversion and Regulation in the Low-Megahertz Range", PCSC Record, 1971, pp. 58–65.

*Primary Examiner*—Peter S. Wong
*Assistant Examiner*—D. L. Rebsch
*Attorney, Agent, or Firm*—Robert Lieber; James A. Kunkle; J. Jancin, Jr.

[57] ABSTRACT

A transformer assembly suitable for use in very high frequency (VHF) switching power supplies that maintains a low leakage inductance between critical transformer windings while complying with the physical and electrical requirements imposed by standards for primary to secondary isolation. The transformer includes a telescopic bobbin assembly with an inner and an outer section that telescope together to form an interior clearance space or chamber between the two sections. The interior chamber has a narrow conduit exiting to the exterior of the bobbin assembly. Described are two embodiments for a transformer used in a forward-averaging type converter and a third embodiment for a transformer used in a frequency modulated converter.

17 Claims, 25 Drawing Figures

FIG. 9A.
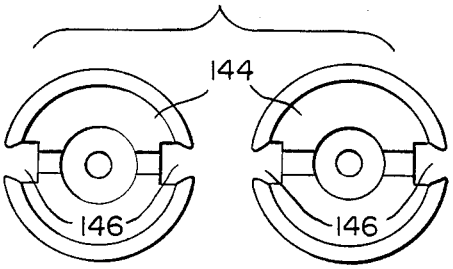
FIG. 9B.
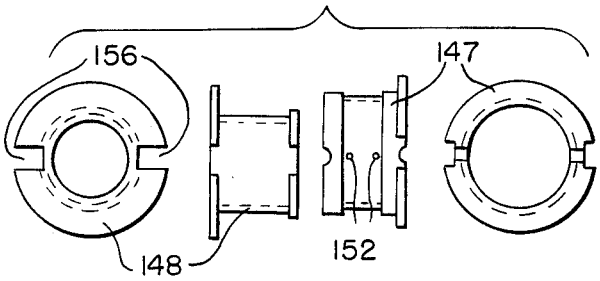
FIG. 9C.
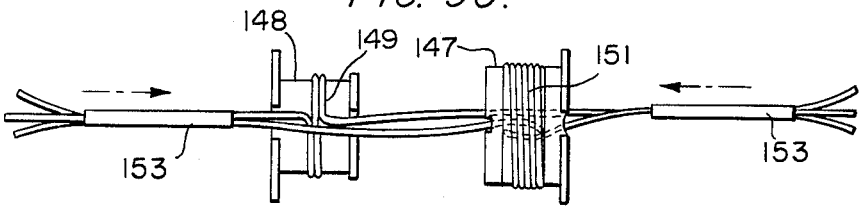
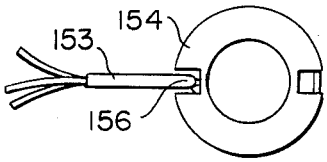
FIG. 10A.
FIG. 10B.
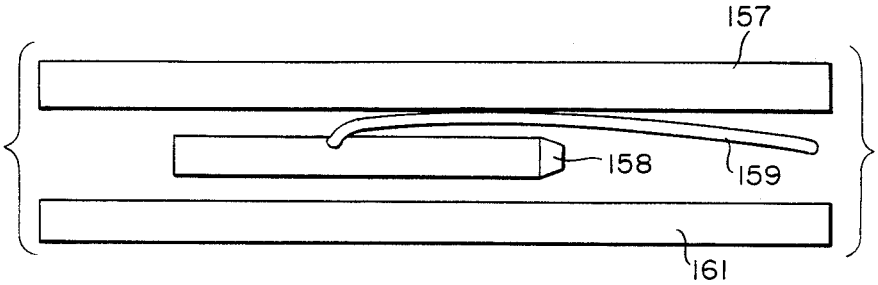
FIG. 10C.
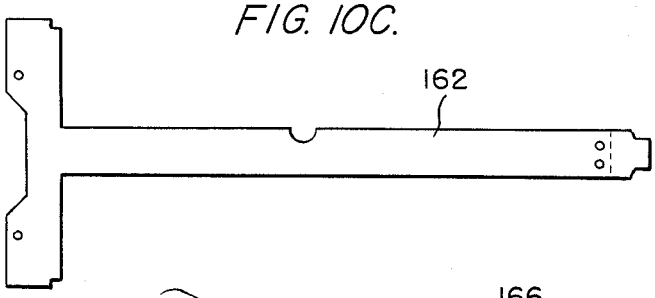
FIG. 10D.
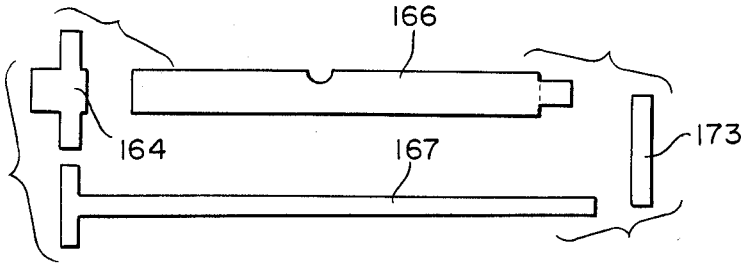

LOW LEAKAGE TRANSFORMERS FOR EFFICIENT LINE ISOLATION IN VHF SWITCHING POWER SUPPLIES

TECHNICAL FIELD

This invention relates to electrical power transformers used in very high frequency (VHF) switching power supplies.

BACKGROUND OF THE INVENTION

Conventional off-line switching power supplies employ transformers to isolate secondary circuits from primary utility line sources. Typically, rectifiers and filter capacitors combine to convert utility line AC to a high DC voltage (100–400 VDC) which, via the transformer, power switching circuitry, and secondary rectifier/filter circuits develops, from the transformer secondaries, lower DC voltages with higher current capability. In this environment, advantages of much smaller filter components and their resulting economies of weight and price can be realized by operating at higher switching frequencies.

Contemporary switching power supplies typically operate with switching frequencies in the vicinity of 20 kiloHertz (KHz). A significant packaging improvement can be realized if such supplies are adapted for operation at switching frequencies up to 1 megaHertz (MHZ). However, operation at this very high frequency (VHF) requires significant changes in transformer construction. For instance, the leakage inductance between primary and secondary windings or between secondary and tertiary windings must be substantially reduced if efficient power transfer is to occur. Minimization of leakage inductance demands that critical conductors be as physically intimate as possible. Other deleterious parasitic effects, such as skin effect, also become of primary concern as switching frequency increases.

Further complications result from geometry and uniformity constraints which tend to conflict with international safety standards that demand voltage isolation of up to 3750 VAC between line referenced primary circuits and secondary circuits to which personnel may be exposed. Other challenges from international standards appear in the form of requirements for conductive safety shields (often called screens) between primary and secondary windings as well as critical spacings of three to eight millimeters along surface paths between primary conductors and other conducting surfaces.

It is therefore desirable to make a power transformer capable of providing the economies of size, weight, and price afforded by operating in the VHF range of switching frequency, while respecting the physical and electrical safety requirements of primary to secondary electrical isolation.

DISCLOSURE OF INVENTION

The invention as herein described and claimed satisfies the aforementioned requirements by providing a power transformer capable of operating in the VHF range of switching frequency by minimizing critical interwinding leakage inductance and other deleterious parasitic effects while respecting the physical and electrical safety requirements imposed by standards for primary to secondary isolation.

The transformer uses a telescopic bobbin assembly with an inner and an outer section that telescope together to form an interior clearance space or chamber between the two sections. The interior chamber typically has a narrow conduit or hole exiting to the exterior of the bobbin assembly. The axis of the conduit is substantially parallel to the longitudinal axis of the bobbin assembly.

A transformer made using the telescopic bobbin assembly has several embodiments depending upon the power converter using the transformer and depending upon the size and shape of the corresponding magnetic core assembly.

In a first embodiment, the transformer is designed for use in a forward-averaging type switching power converter and uses a pot-type magnetic material core assembly. Another embodiment is also designed for use in a forward-averaging type converter and employs an E-type magnetic material core assembly. In these forward-averaging type embodiments, the leakage inductance between the primary winding and the secondary windings is minimized to obtain favorable operation of the transformer in the VHF range. The primary winding is coiled on the outer bobbin section with leads passing through holes in the outer bobbin section to the interior chamber defined by the inner and outer bobbin sections. The primary leads then exit from the bobbin assembly through the narrow conduit to the outside. A secondary winding is then coiled in physically intimate relation over the primary winding on the outer section of the bobbin.

A third embodiment is a transformer designed for use in a frequency modulated (FM) switching power converter using an E-type magnetic material core assembly. In this FM embodiment, the leakage inductance between the secondary windings and tertiary windings is minimized. In this third embodiment, the primary winding is coiled on the inner bobbin section occupying the interior chamber with leads exiting through the aforementioned conduit. The secondary and tertiary windings are coiled on the outer bobbin section in physically intimate relation.

Additional features of the invention will be apparent from the following detailed description with reference to the accompanying drawing.

BRIEF DESCRIPTION OF THE DRAWING

FIG. 9 is a pot-type ferrite core used in a third embodiment of this invention.

FIG. 9*b* is a telescopic bobbin used in a third embodiment of this invention.

FIG. 9*c* is a partially assembled bobbin assembly used in a third element of this invention.

FIG. 10*a* is the completed bobbin assembly of FIG. 9*c*.

FIGS. 10*b*, *c* and *d* are winding and insulating components used in a third embodiment of this invention.

DESCRIPTION OF THE INVENTION

Figure 1:
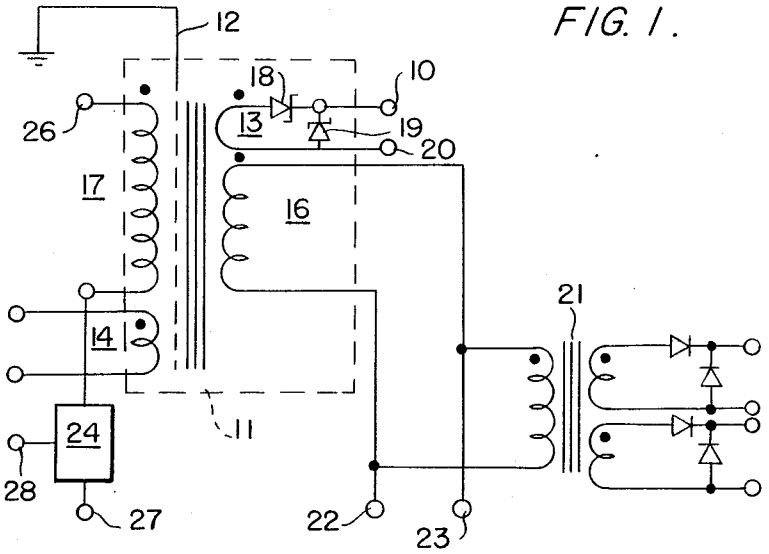
FIG. 1 is a simplified schematic of a forward-averaging type converter employing a transformer according to this invention.

The simplified schematic of FIG. 1 is a power stage of a forward-averaging type switching converter using a transformer 11 according to this invention. Transformer 11 features a ground-referenced protective inter-winding shield 12, a single turn secondary 13, a primary referenced service voltage winding 14, an intermediate secondary winding 16, and a primary winding 17.

Although the preferred embodiments of transformer 11 hereinafter described include a safety shield 12, the shield 12 can be omitted without affecting the performance of transformer 11 and without deviating from the objects of this invention.

Diodes 18 and 19 serve as a rectifying diode and as a free-wheeling diode respectively. Secondary terminals 10 and 20 are connected to a filter (not shown) using inductive and capacitive components to produce a useable filtered output voltage. For VHF applications, diodes 18 and 19 are typically fast reverse recovery diodes with a low forward voltage drop. Ideally suited for this application are Schottky diodes.

Intermediate winding 16 is a line-isolated secondary that can be used to drive a small transformer 21 to produce additional output voltages as may be required. Transformer 21 is not required to meet stringent safety requirements imposed on transformer 11 since transformer 21 is already isolated from primary conductors by intermediate winding 16. Additional transformers, similar to transformer 21, can be appended to terminals 22 and 23 to produce even more output voltages.

Single turn winding 13 generates the lowest output voltage which usually represents the highest output current. In applications where only a single output voltage is required, intermediate winding 16 and transformer 21 can be eliminated.

Primary winding 17 is driven by a chopped DC voltage created by a fast switching device 24 which chops a high DC voltage applied between terminals 26 and 27. Generally, this high DC voltage is in the range of 100 to 400 VDC and is derived from a sinusoidal utility power source by rectifying and filtering means (not shown). Switching device 24 is typically controlled by a constant-frequency pulse-width- modulated (PWM) signal applied to control terminal 28. This control signal causes device 24 to switch between a conductive and a non-conductive state thereby performing the aforementioned chopping function. For VHF, switching applications, switching device 24 is typically a high-voltage, high-current field effect transistor (FET).

The PWM signal applied to terminal 28 is usually produced by a feedback system (not shown) that senses the output voltage or voltages created by the converter and compares this voltage against a reference. The feedback system uses the result of this comparison to modulate the pulse signal applied to terminal 28 of device 24 in order to maintain a relatively constant output voltage regardless of the magnitude of the DC input voltage applied between terminals 26 and 27 and regardless of the output power supplied by the converter.

Service winding 14 can be rectified and filtered to provide a low voltage power source for electrical circuitry located on the primary side of transformer 11.

Figure 2:
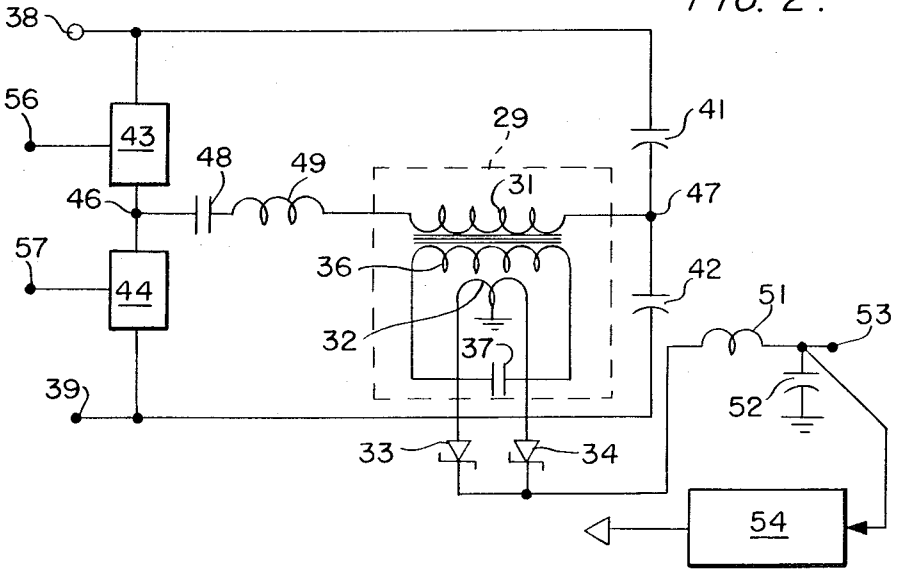
FIG. 2 is a simplified schematic of a frequency-modulated type converter employing a transformer according to this invention.

Referring now to FIG. 2, transformer 29 is another embodiment of this invention and is applied in a typical frequency-modulated (FM) converter power stage. Transformer 29 includes primary winding 31, center-tapped secondary winding 32 with rectifying diodes 33 and 34, and tertiary winding 36 with tertiary capacitor 37.

A high DC voltage, which can be derived from a sinusoidal utility source using rectifiers (not shown) is applied between terminals 38 and 39 across both bulk capacitors 41 and 42. This DC voltage is typically in the range of 200 to 400 VDC. Switching devices 43 and 44 operate alternately each with a 50% duty cycle to form a balanced square wave voltage between terminal 46 and terminal 47. Any minor imbalance in voltage symmetry is compensated by series blocking capacitor 48. For VHF switching applications, devices 43 and 44 can again be high-voltage, high-current FETs.

Tertiary capacitor 37 is reflected into the primary circuit by transformer 29 and together with inductor 49 forms a filter network that operates on the square wave voltage between terminals 46 and 47. As the frequency of the square-wave voltage increases (due to an increase of the switching frequency of devices 43 and 44), the voltage appearing across tertiary capacitor 37 and winding 36 decreases.

This reduction in voltage is reflected in secondary winding 32 which, after rectification by diodes 33 and 34, and filtering by inductor 51 and capacitor 52, causes the output voltage at terminal 53 to decrease. An opposite result will occur for a decrease in switching frequency. Therefore, the switching frequency of devices 43 and 44 can be used to ultimately vary the output voltage appearing at terminal 53. In practice, control block 54 compares the voltage sensed at output terminal 53 to a reference voltage (not shown) and produces variable frequency, out of phase, pulsed signals which are applied to control terminals 56 and 57 of devices 43 and 44, respectively.

Although not shown in FIG. 2, additional output voltages can be created by appending additional transformers to tertiary winding 36 similar in fashion to transformer 21 shown in FIG. 1.

Unlike the forward-averaging PWM circuit of FIG. 1, wherein the switching frequency is constant and regulation is accomplished by varying the pulse width of the applied control signal, the FM circuit of FIG. 2 maintains regulation by varying the frequency of the control signal with the pulse width held at a constant 50% duty ratio.

In the forward-averaging circuit of FIG. 1, the leakage inductance between the primary winding 17 and the secondary windings 13, 16 becomes a major concern as the switching frequency increases. This leakage inductance must be minimized in order to permit efficient power transfer. In the FM circuit of FIG. 2, the minimization of the leakage inductance between primary 31 and secondary 32 is not as critical because this leakage inductance appears in series with inductor 49. However, in this FM topology, the leakage inductance between secondary 32 and tertiary 36 does require minimization. Therefore, power topologies illustrated in FIGS. 1 and 2 each require a reduction in leakage inductance between critical windings in order to enhance operation with switching frequencies in the VHF range.

Reducing leakage inductance between critical windings requires that these windings be as physically intimate as possible. However, safety standards adopted by many countries demand that electrical apparatus using utility power sources maintain electrical isolation between utility referenced primary circuits and secondary circuits to which personnel may be exposed. These isolation standards typically require physical isolation in terms of creepage and clearance distances measured over surface paths as well as high-potential voltage breakdown minimums. Some countries, for example England, even require ground referenced conductive shields to be interposed between primary and secondary windings in a transformer. These national standards appear to be contrary to the aforementioned requirements for operation of switching power supplies in the VHF range. The three transformer embodiments, hereinafter described, combine unique telescopic winding bobbin designs with improved transformer winding techniques to produce transformers for application in the forward-averaging switching topology of FIG. 1 and for application in the FM switching topology illustrated in FIG. 2. The resulting transformers minimize critical interwinding leakage inductances as well as other parasitic electrical effects that manifest themselves with increasing switching frequency. At the same time, the transformers comply with national and international safety standards, thereby allowing products incorporating the transformers to enjoy worldwide marketability. The designation of these three embodiments is intended for illustrative purposes only, and will not be construed to delimit the invention in any manner.

FM Transformer

Figure 4A:
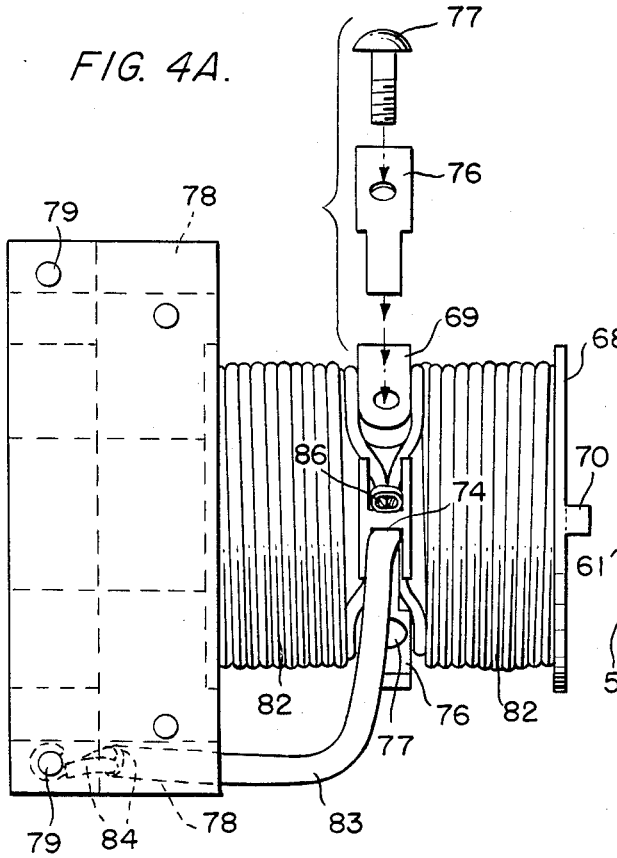
FIG. 4*a* is the bobbin sleeve section of FIGS. 3*b* and 3*d* with windings.
Figure 4B:
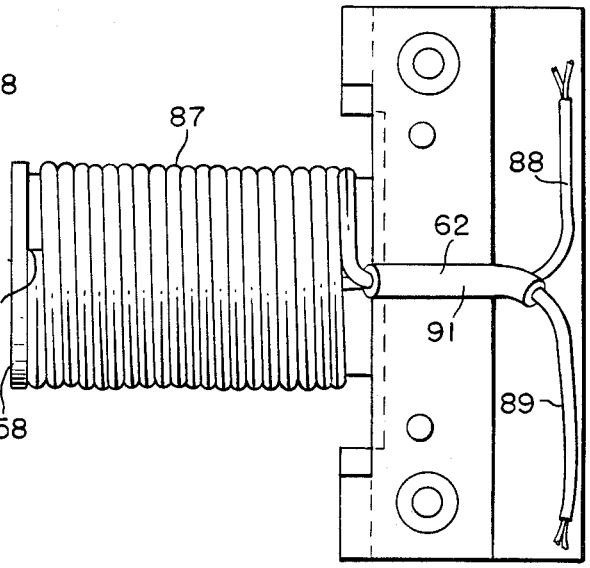
FIG. 4*d* is the bobbin tube section of FIGS. 3*a* and 3*c* with a winding.
Figure 5:
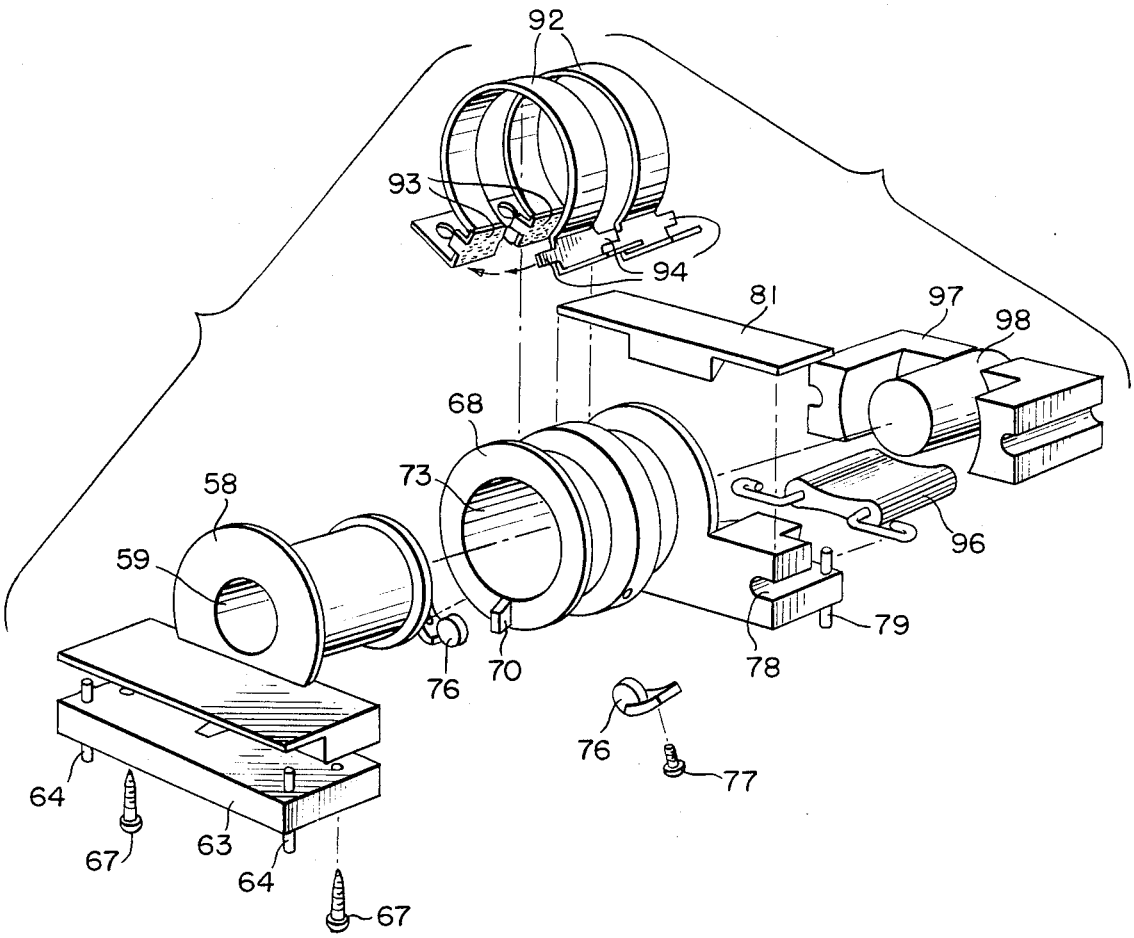
FIG. 5 is an exploded view of a transformer using an E-type core for use in a FM converter.
Figure 6A:
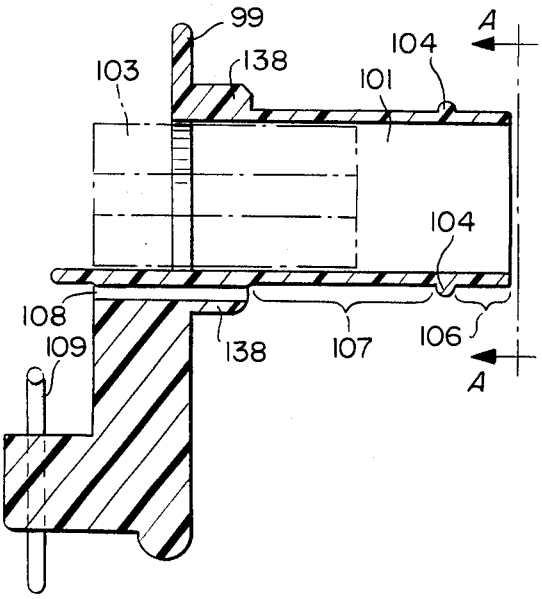
FIG. 6*a* is a cross-sectional view of another bobbin tube section used in a second embodiment of this invention.
Figure 6B:
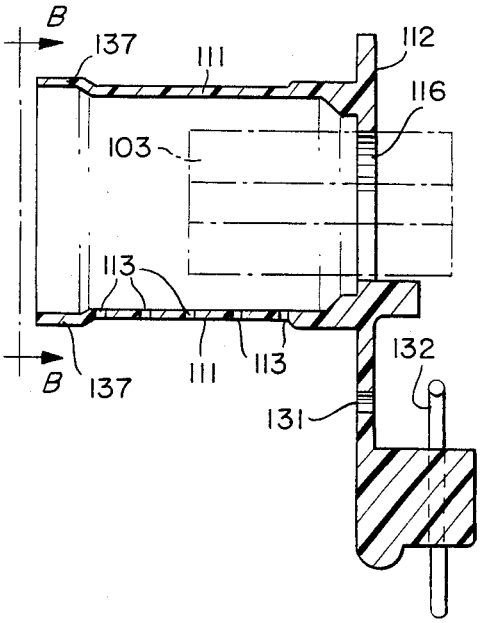
FIG. 6*b* is a cross-sectional view of another bobbin sleeve section used in a second embodiment of this invention.
Figure 6C:
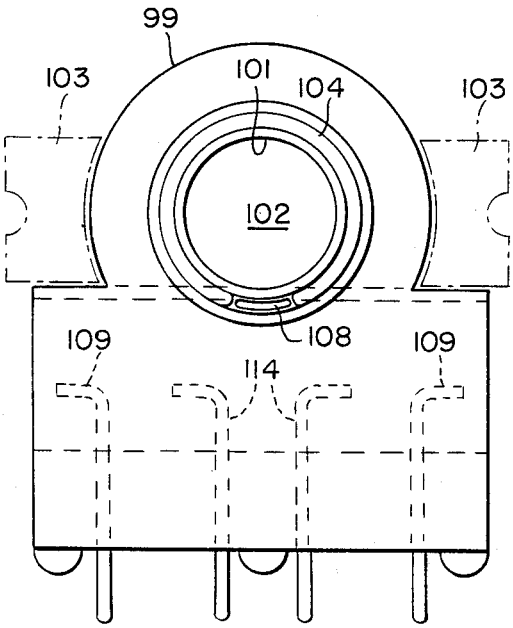
FIG. 6*c* is a a view from A—A in FIG. 6*a* of a non-sectioned bobbin tube.
Figure 6D:
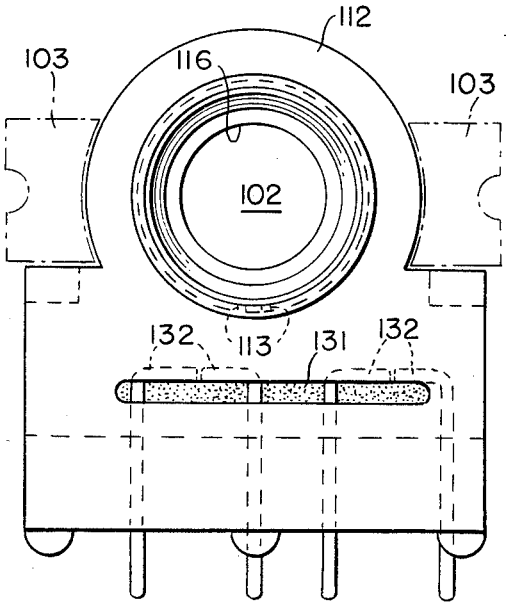
FIG. 6*d* is a view from B—B in FIG. 6*b* of a non-sectioned bobbin sleeve.

A first embodiment illustrated in FIGS. 3, 4 and 5 presents a transformer for use in a FM (FIG. 2) converter operating at a nominal switching frequency of 0.5 MHz with an output power of approximately 250 Watts.

Figure 3A:
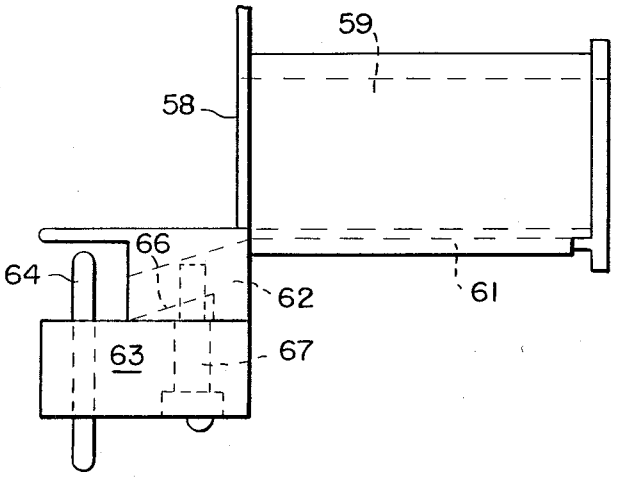
FIG. 3*a* is a profile of a bobbin tube section used in a first embodiment of this invention.
Figure 3C:
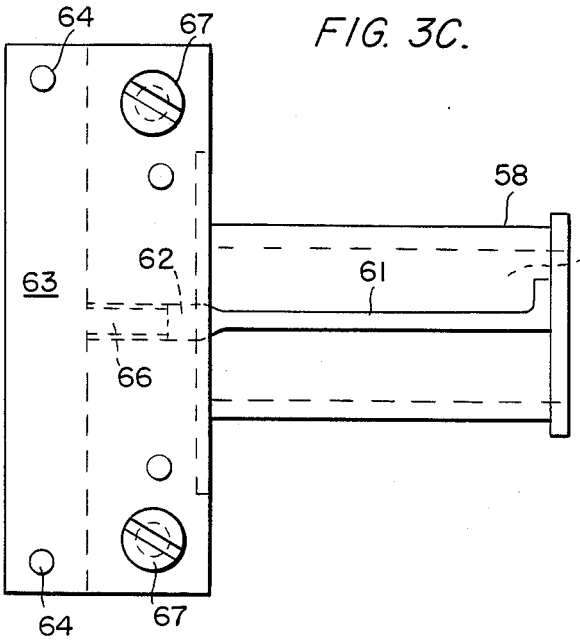
FIG. 3*c* is a bottom view of the bobbin tube of FIG. 3*a*.

Referring now to FIG. 3*a*, primary bobbin tube 58 is a plastic molding. A bottom view of tube 58 is shown in FIG. 3C. Bobbin tube 58 has a cylindrical passage 59 therethrough to accept a pole portion of a magnetizable material core assembly which assembly is described later. Tube 58 also has a primary lead slot 61, to facilitate winding the primary, and a narrow isolated conduit 62 to allow the primary leads to exit the bobbin tube 58. Primary terminal base 63 supports primary terminals 64 to which the primary leads are attached after exiting tube 58 through conduit 62. Base 63 also has a lead retainer portion 66 to secure the primary leads within conduit 62 after assembly. Primary terminal base 63 is attached during final assembly to bobbin tube 58, for example, by screws 67.

Figure 3B:
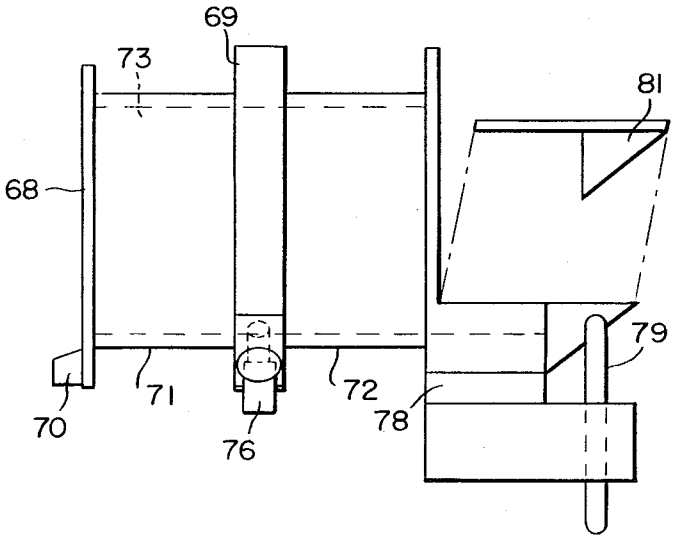
FIG. 3*b* is a profile of a bobbin sleeve section used in a first embodiment of this invention.
Figure 3D:
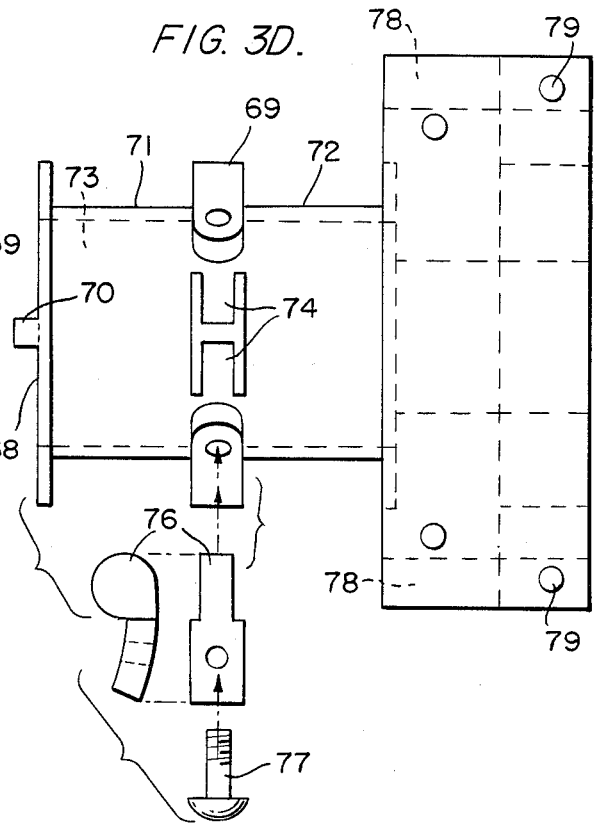
FIG. 3*d* is a bottom view of the bobbin sleeve of FIG. 3*b*.

The tertiary/secondary bobbin sleeve 68 is shown in profile in FIG. 3*b* with a bottom view in FIG. 3*d*. Bobbin sleeve 68 is also a plastic molding. Bobbin sleeve 68 has a winding separator 69 which divides sleeve 68 into two sections 71 and 72. Sections 71 and 72 will each receive half of a parallel wound tertiary winding, which winding is described later. Bobbin sleeve 68 has a substantially cylindrical passage 73 therethrough to accept bobbin tube 58 in a telescoping fashion during final assembly. When assembled, bobbin tube 58 and bobbin sleeve 68 form a substantially cylindrical clearance space. Alignment key 70 mates with a portion of conduit 62 of bobbin tube 58 and serves to ensure proper alignment of tube 58 and sleeve 68 during final assembly.

Bobbin sleeve 68 also includes tertiary strain relief slots 74 through which the tertiary winding passes. The tertiary winding is held in slots 74 by tertiary lead retaining means, for example, retainer 76 which can be attached to bobbin sleeve 68 by self-binding pin 77. From slots 74, the tertiary leads pass through conduits 78 and terminate at tertiary terminals 79. Tertiary terminal cover plate 81 attaches to bobbin sleeve 68.

The winding and assembly of the FM transformer is shown in FIGS. 4 and 5. In FIG. 4*a*, the dual parallel tertiary windings 82 are begun on bobbin sleeve 68 by slipping a thin insulating sleeving 83 over a pair of tertiary wires 84. Tertiary wires 84 can be of conventional magnet wire, or can be of Litz wire in order to reduce the skin effect and current crowding in tertiary winding 82. Litz wire is a wiring arrangement consisting of many individually insulated strands of fine gauge wire with each strand taking all possible positions in cross-sections of the group taken over some reasonable length of wire. Wire pair 84 and sleeving 83 are dressed into tertiary strain relief slot 74 and are secured by retainer 76 and pin 77.

Tertiary windings 82 are wound as a pair of parallel windings on either side of winding separator 69. Dual windings are necessary for symmetrical mating with the dual secondary bands 92 (shown in FIG. 5), thereby maintaining minimal, uniform leakage inductance on either side of the secondary center tap. Both tertiary windings 82 proceed to their respective opposite ends of bobbin sleeve 68 forming a first layer of turns which is then covered by a single layer of insulating tape (not shown). Windings 82 then return to separator 69 as a second layer of turns. The remaining tertiary leads 86 (shown in cross-section) are dressed into the remaining slot 74 and secured by another retainer 76 and pin 77.

Tertiary leads 86 are then covered by an insulating sleeving (not shown). Termination of the tertiary leads to pins 79 is deferred until the secondary bands 92 are mounted in a subsequent step.

Referring now to FIG. 4*b*, primary winding 87 is started on bobbin tube 58 by laying wire 88 in conduit 62 and into slot 61. Wire 88 can be, for example, Litz wire or conventional magnet wire. The turns of primary winding 87 are then wound back down the bobbin tube 58 toward conduit 62. After the final turn, the remaining lead 89 is fitted with insulating sleeving 91 and dressed into conduit 62.

Final assembly of the FM transformer is illustrated in FIG. 5. Primary winding 87 on tube 58 and tertiary windings 82 on sleeve 68 (FIG. 4) are not shown in FIG. 5 in order to improve clarity.

Secondary winding bands 92 each represent one turn on either side of a center-tap secondary (shown schematically as item 32, FIG. 1), which center-tap can be established, for instance, by a conductive land pattern on the printed circuit card on which the FM transformer is ultimately mounted. Secondary bands 92 are formed, for example, from stamped copper strip. Secondary bands 92 are fitted over the tertiary windings, oriented into position, and closed by drawing the band ends together against band insulators 93. Secondary bands 92 are maintained in a closed position by retaining means, for example, foldable tabs 94. Tertiary winding leads (not shown) are then routed through conduits 78 and soldered to tertiary terminal pins 79.

At this point, tertiary capacitor 96 is attached to tertiary terminals 79 and soldered. Tertiary capacitor 96 is a high-frequency capacitor, for instance, a silver-mica type capacitor. Tertiary terminal cover plate 81 is then secured to bobbin sleeve 68.

Primary leads 88 and 89 (FIG. 4*b*) are now attached and soldered to primary terminals 64 and primary terminal base 63 is attached to bobbin tube 58.

Bobbin tube 58 and bobbin sleeve 68 are now telescoped together with tube 58 entering cylindrical passage 73. After telescopic assembly, primary winding 87 (FIG. 4*b*) occupies an isolated interior clearance space formed by bobbin tube 58 and bobbin sleeve 68. A two-piece magnetizable material core assembly (one piece 97 shown in FIG. 5) is then installed in the bobbin assembly with pole portion 98 entering the cylindrical passage 59. The magnetizable material core assembly can be, for example, an EC-35 type core manufactured by Ferroxcube Corporation.

A transformer constructed according to this method, and of a size consistent with the aforementioned EC-35 type core, demonstrates a leakage inductance reflected to the primary with the tertiary shorted of 2.35 micro-Henry, reflected to the primary with one side of the secondary shorted to the center-tap of 5.38 micro-Henry, and reflected to the tertiary with one side of the secondary shorted to the center-tap of 2.81 micro-Henry.

Here it should be noted that although this FM transformer has no safety shield interposed between primary and secondary windings, the transformer still complies with international safety requirements due to the unique two-piece bobbin structure

Forward-Averaging Transformer With E Core

Figure 7:
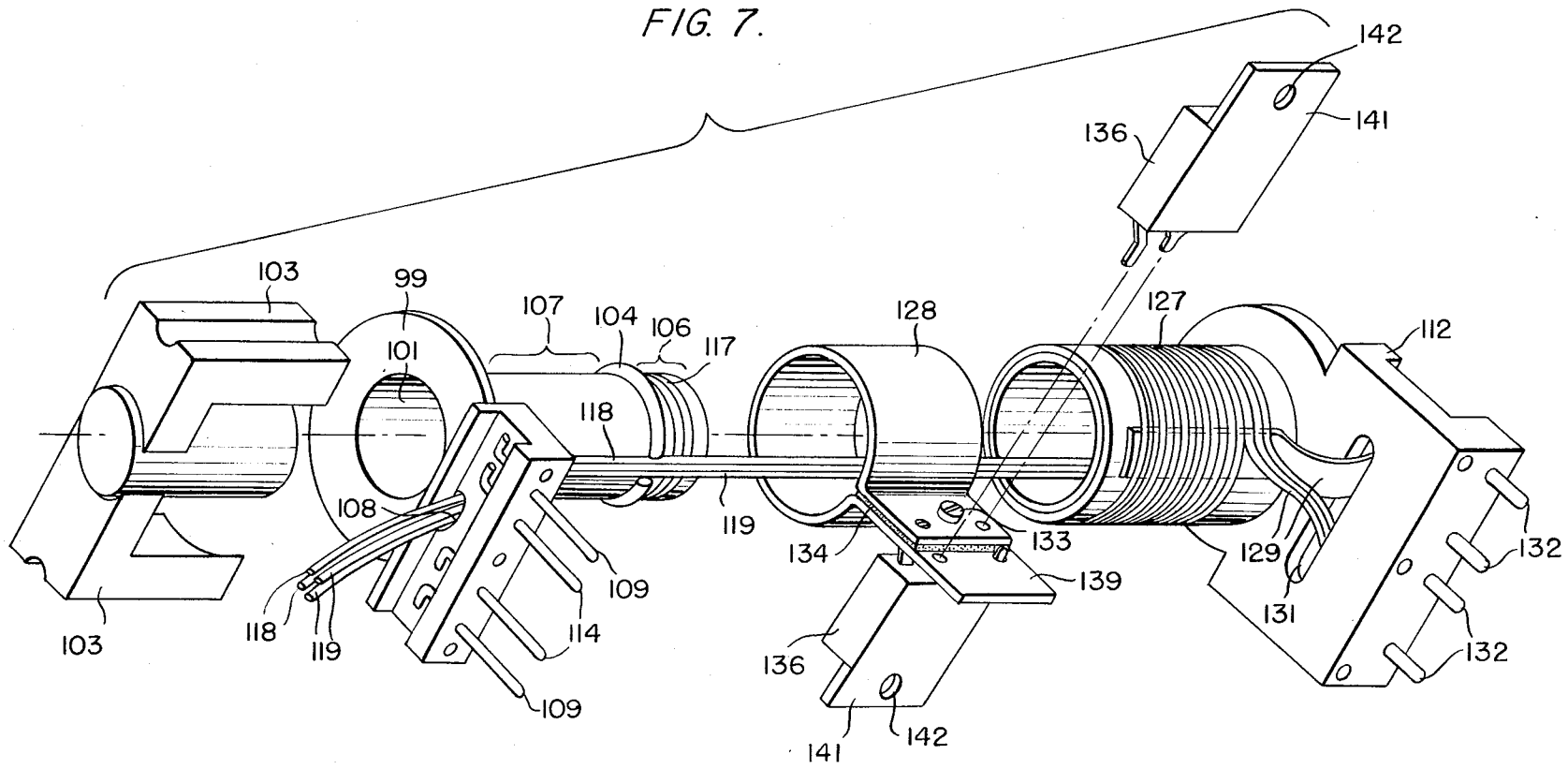
FIG. 7 is an exploded view of a transformer using an E-type core for use in a forward-averaging converter.
Figure 8:
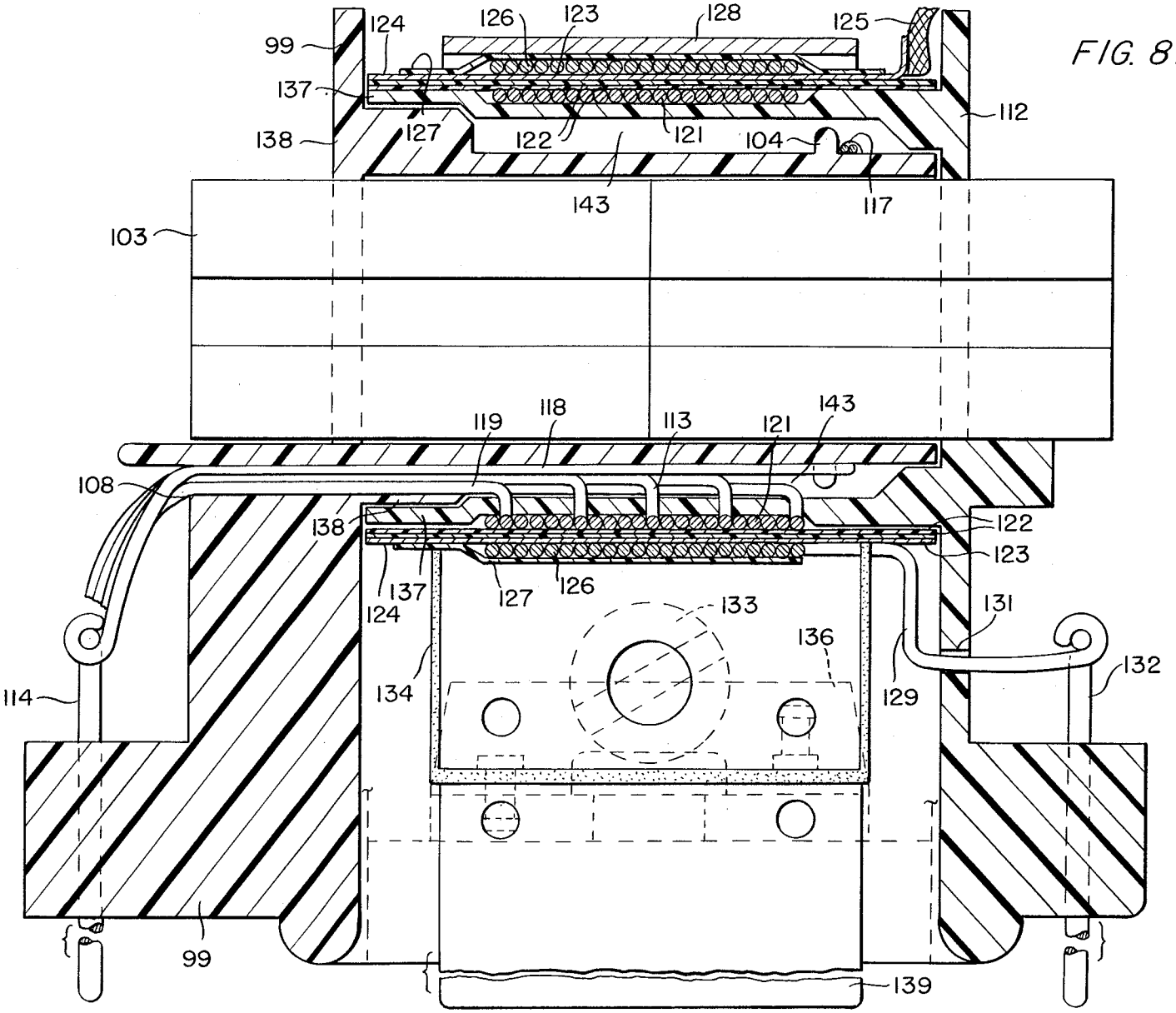
FIG. 8 is a cross-section of the transformer of FIG. 7 after assembly.

A second embodiment of this invention is illustrated in FIGS. 6, 7 and 8. This second embodiment is a transformer for use in a forward-averaging converter (see also FIG. 1) operating at a switching frequency of approximately 1 MHz with an output power of approximately 250 Watts.

FIG. 6 is a two-piece bobbin employing an E-type magnetizable material core assembly. FIG. 6*a* is a cross-section through a profile of bobbin tube 99. FIG. 6*c* is a view from A—A in FIG. 6*a* of non-sectioned bobbin tube 99. FIG. 6*b* is a cross-section through a profile of bobbin sleeve 112. FIG. 6*d* is a view from B—B in FIG. 6*b* of non-sectioned bobbin sleeve 112.

Referring to FIG. 6, bobbin tube 99 is a plastic molding and has a cylindrical passage 101 therethrough to accept a cylindrical pole portion 102 of E-type magnetizable material core assembly 103 (shown in dashed lines in FIG. 6). All windings of the transformer are wound on bobbin sleeve 112 with the exception of the primary service voltage winding 117 (shown schematically as item 14, FIG. 1) which is wound on section 106 of bobbin tube 99. Bobbin sleeve 112 is also a plastic molding with a cylindrical passage 116 therethrough to accept a cylindrical pole portion 102 of magnetizable material core assembly 103.

Referring to FIGS. 6 and 7, tube lip 104 encompasses approximately 320 degrees of the circumference of tube 99 and serves to prevent the movement of the primary service voltage winding 117 during telescopic assembly of tube 99 and sleeve 112.

The two leads 118 of the primary voltage service winding 117 pass through the break in tube lip 104, pass section 107 of tube 99, and exit the bobbin assembly through narrow conduit 108. The two service voltage leads 118 are soldered to a pair of service voltage terminal pins 109 in a later step.

The primary winding (shown schematically as item 17, FIG. 1) is wound in recess 111 of bobbin sleeve 112. The primary is typically a multi-conductor winding which is parallel wound with leads 119 (FIG. 7) passing through sleeve lead ports 113 (FIG. 6) into a chamber formed in the vicinity of section 107 of tube 99. The primary leads then pass through narrow conduit 108 to be soldered to primary terminal pins 114.

Referring now to FIG. 8, which is a cross-section of the completed transformer, primary winding 121 is covered by two layers 122 of thin insulating tape wide enough to cover the full width of sleeve 112. Over double layer 122, a safety shield or screen 123, made from a single wrap of thin conductive tape, for example, copper, is placed to cover the entire length of bobbin sleeve 112. Soldered to conductive shield 123 is braided wire 125 which serves as a conductor to attach shield 123 to a grounded surface when the transformer is employed in a power converter.

The shield is covered by a thin insulating layer 124. The next layer is the intermediate secondary (shown schematically as item 16, FIG. 1). Intermediate secondary 126 typically includes multiple turns of parallel strands of wire. After completion of the winding of intermediate secondary 126, intermediate secondary leads 129 pass through conduit 131 in bobbin sleeve 112 and are soldered to intermediate secondary terminal pins 132. Intermediate secondary 126 is then covered by a thin layer of insulation 127.

Winding layer 128 is a formed band of conductive material, for example, copper, that forms a single turn secondary winding (shown schematically as item 13, FIG. 1). Formed winding 128 is slipped over insulating layer 127, and associated under layers heretofore described, on bobbin sleeve 112. Retention means, for example, insulating screw 133 is used to close winding 128 firmly against insulator 134.

Diode packages 136 each contain two diodes used, in this application, as a rectifying diode (18, FIG. 1) and as a free wheeling diode (19, FIG. 1). Two packages 136 can be used resulting in two sets of parallel connected diodes, each set containing one rectifying diode and one free-wheeling diode. For applications involving lighter output current requirements, one diode package 136 may be eliminated. For VHF applications, the diodes in package 136 are typically Schottky diodes. Diode packages 136 are inserted into winding 128 from opposite sides as shown in FIG. 7, and are soldered into place. Referring to FIG. 7, the bobbin tube 99 and the bobbin 112, each with windings apportenant, are united by telescoping tube 99 into sleeve 112. During this telescopic assembly, primary leads 119 and service voltage leads 118 are routed through narrow conduit 108 and terminated by soldering to appropriate pins 109 and 114. When completely assembled, sleeve rim 137 abutts tube shoulder 138 as shown in FIG. 8.

After telescopic assembly, an isolated chamber (143, FIG. 8) is formed between bobbin tube 99 and bobbin sleeve 112 in the vicinity of region 107 of bobbin tube 99. Primary leads 119 enter chamber 143 through holes 113 in bobbin sleeve 112. Primary leads 119 pass through isolated chamber 143 with primary service voltage leads 118 and both sets of leads exit the bobbin assembly through isolated conduit 108.

A transformer manufactured according to this method will surpass all national safety requirements promulgated worldwide. At the same time, when constructed to dimensions consistent with the aforementioned EC-35 type core, the transformer exhibits a leakage inductance between the primary and single turn secondary of 0.35 microHenry, and a leakage inductance between the primary and intermediate secondary of 0.2 microHenry.

Very low leakage inductance between primary conductors 121 and the single-turn secondary 128 is achieved by the effective flatness of the primary 121 and the flat copper band structure 128 which links the secondary 128 uniformly across primary turns 121. The low leakage inductance between the primary 121 and intermediate secondary 126 is achieved by the effective flatness, proximity, and uniformity of each winding, and by the choice of conductor gauge, strand-count, and turns ratio which results in maximum coupling between each turn of primary 121 and each turn of intermediate secondary 126.

When mounting the transformer to a mounting surface such as a printed circuit board, terminal pins 109, 114, and 132 are inserted into holes in the board's surface and are soldered to conductive circuit paths disposed on the surface of the board in order to complete electrical paths between primary 121, secondary 126 and other components mounted on the board. Extended portion 139 of flat winding 128 is inserted into a slot-shaped hole in the printed circuit board and is also soldered to conductive circuit paths disposed on the surface of the printed circuit board. Dual diode packages 136 are attached to heat sinks with screws (neither shown). In practice, the heat sinks are mounted very near or even partially under the transformer. Dual diode packages 136 are typically configured so that the tab portion 141 with screw hole 142 is the common cathode terminal of the packaged diodes.

Forward-Averaging Transformer With Pot-Core

A third embodiment of a transformer according to this invention is illustrated in FIGS. 9, 10, 11, 12, and 13. This third embodiment is a transformer for use in a forward-averaging converter (FIG. 1) operating at a switching frequency of 1 MHz with an output power of approximately 200 Watts.

FIG. 9*a* illustrates a standard ferrite material pot-type core 144. Pot-core 144 typically has lead wire exit ports 146 to allow windings to exit from the interior portion of pot-core 144.

A two-section telescopic bobbin design is illustrated in FIG. 9*b*. Inner tube section 148 fits within outer sleeve section 147, in telescoping fashion, after windings on each section have been formed. Inner section 148 and outer section 147 are both plastic moldings. A simple two-turn service voltage winding 149 (shown schematically as item 14, FIG. 1), of fine wire is wound on inner section 148 and held in place with a drop of adhesive such as a common cyanoacrylate as shown in FIG. 9*c*. One of the service voltage winding leads departs to the left, the other service voltage winding lead departs to the right and through the outer sleeve 147 which has the primary coils,(shown schematically as item 17, FIG. 1) wound uniformly upon it in the form of a single layer of wire 151. Primary 151 can be, for example, a pair of wires wound bifilar. The winding leads from the primary pass through the holes 152 visible in outer sleeve 147. Primary leads passing through the right hole 152 exit to the left, and vice versa. All leads exiting to the left are slipped into a length of insulating sleeving 153 and leads exiting to the right are treated similarly in a separate sleeving 153. The inner tube 148 and outer sleeve 147 are now telescoped together into a single structure with care taken not to kink or tangle the leads. The tube 148 and sleeve 147 can be cemented with adhesive at this time.

At this point, all winding leads exit the combined bobbin assembly from an isolated interior chamber between the tube 148 and the sleeve 147. The segments of insulating sleeving 153 are then slipped along the primary leads into the chamber between the tube 148 and sleeve 147 as far as they will fit, close to the mid-point of the combined bobbin assembly. The two lead sets 153 are turned forward (FIG. 10*a*) to occupy one pair of lead exit conduits 156 in the bobbin assembly 154.

On the paritially completed bobbin assembly 154, a double layer of insulating tape 157 is wrapped (refer to FIG. 10*b*). A conductive shield or screen 158(shown schematically as item 12, FIG. 1) is placed over the double layer insulation 157, with an insulated ground or earthing wire 159 soldered to shield 158 and positioned toexit the assembly in the same orientation as one of the primary lead sets 153.

Figure 11:
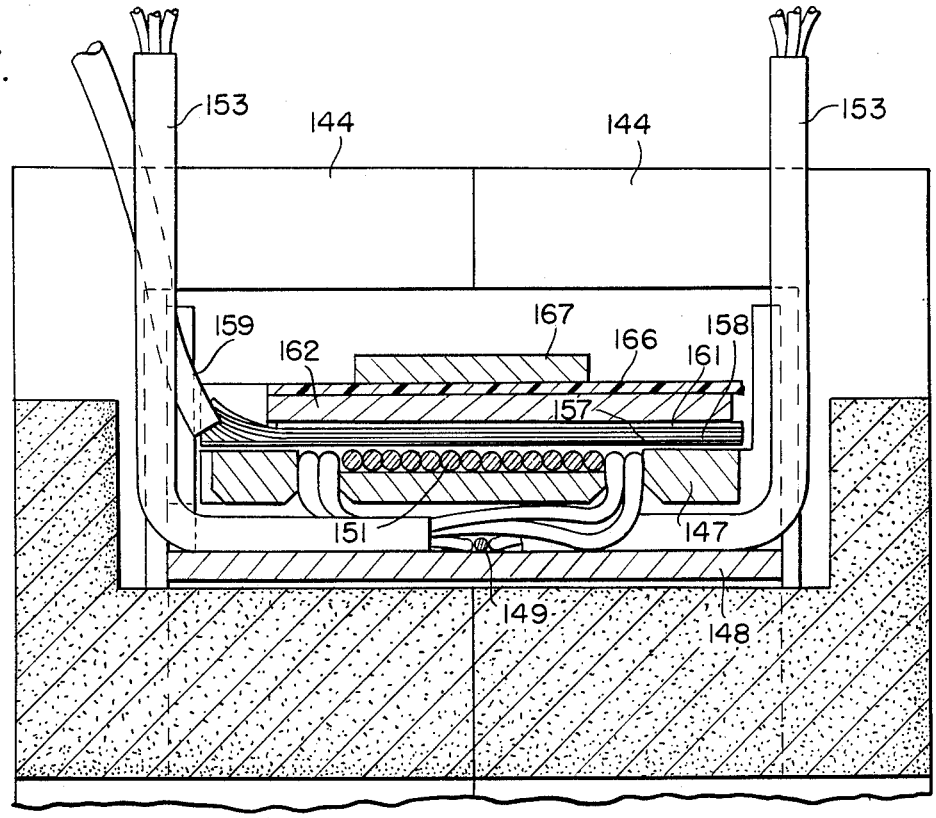
FIG. 11 is a horizontal section detail of a pot-type core transformer for a forward-averaging type converter.

As viewed in the cross-section of FIG. 11, the creepage path along the interface between the outer sleeve 147 and insulating layer 157, from the existing conductors 153 of the primary winding to the nearest non-insulated edge of the shield wrap 158, is 3 mm. This satisfies the most stringent international electrical safety requirements. Furthermore, the electrical high-pot breakdown between the primary coils 149, 159, and ferrite core 144, or between the primary coils 149, 151 and shield 158 through the double insulation layer 157 is in excess of 3750 VAC, surpassing another important safety standard.

Another double layer of insulating tape 161 is wrapped over the copper shield before the shield 158 is completely formed in order to insulate the overlapping tab on the right of shield 158 from the opposite end of shield 158. This prevents the shield 158 from becoming a shorted turn.

Figure 12:
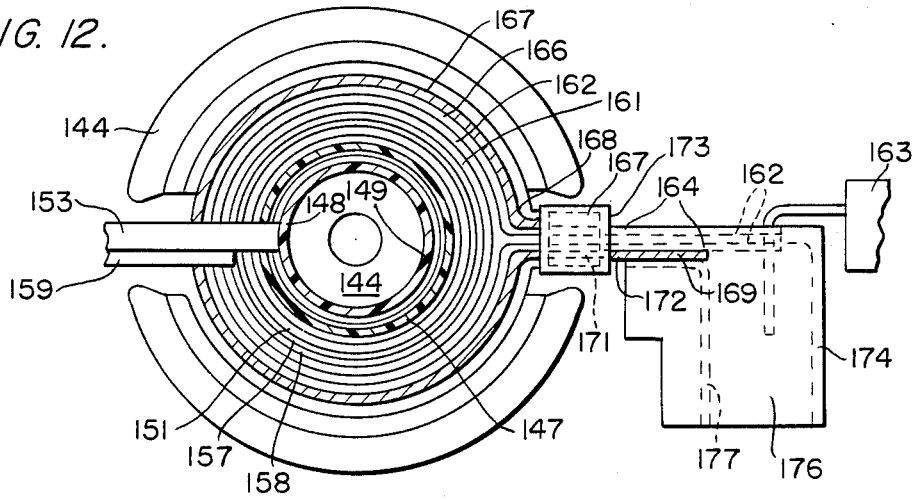
FIG. 12 is a vertical section detail of the transformer of FIG. 11.
Figure 13:
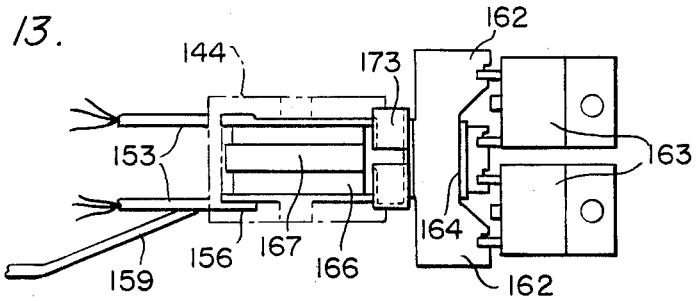
FIG. 13 is a top view of a completed pot-type core transformer for a forward-averaging type converter.

Copper stamping 162 (FIG. 10*c*), formed in a jig to conform to the circular ring and laminer bus configuration of FIG. 12, fits snuggly over insulating layer 161.

Stamping 162 forms a high current single-turn low-leakage inductance winding (shown schematically as item 13, FIG. 1) which can be directly connected to the leads of plastic encapsulated Schottky rectifier components 163. Insulating spacer 164 is placed to insulate the laminar bus portion of stamping 162 with its ears folded around over the upper conductor to prevent the next winding 167 from shorting to the upper conductor.

One of two copper stamping 167 on plastic insulator 166 are partially formed in respective shapes suggested in FIG. 12. Insulator 166 is placed in position over winding bus 162 and held in place with a drop of adhesive applied at points 168 and 169. The second single turn winding and bus stamping 167 is placed as shown in FIG. 12 and the ears are folded under the laminer bus assembly 162 and 164, crimping the assembly together and making contact to the under surface of lower bus member 162 at point 171. Solder applied to this interface assures a reliable connection.

After securing the bus end of stamping 167 at point 172, with a drop of adhesive, a final plastic insulator strip 1723 is folded over the crimped and soldered portion of stamping 167. This final insulator does not require adhesive as it is held in place by pot core 144, which is closed about the assembly and held together with a non-ferrious nut and bolt (not shown) after the Schottky diode assemblies 163 have been soldered to the structure (see FIG. 13). For lighter output current requirements, one diode assembly 163 may be eliminated.

A simple connector may be attached to the primary coil leads of the transformer in order to facilitate connecting the leads to printed circuit card. The secondary winding connections are interfaced to a printed circuit board via tabs (174, 176, and 177, FIG. 12). Outputs from the rectifiers 163 are available at the middle tabs of recifiers 163.

Certain modifications of the illustrated embodiments will be evident to those skilled in the art. It is intended that the appended claims define the present invention broadly enough so as to cover these modifications.

I claim:

1. A transformer suitable for VHF power conversion applications comprising:

a magnetizable material core assembly;

a telescopic bobbin assembly mountable on a pole portion of the core assembly, said bobbin assembly having inner and outer sections telescoping together and forming an interior clearance space between said sections and providing an isolated conduit from said interior clearance space to the outside of the bobbin assembly, said conduit being substantially parallel to the longitudinal axis of the bobbin assembly;

a first conductive lead coiled on the inner section of the bobbin assembly forming a primary winding having ends exiting from said bobbin assembly through said isolated conduit, said primary winding substantially occupying said interior clearance space;

a multi-turn tertiary winding coiled on the outer bobbin section; and at least one secondary winding, each formed from a continuous sheet of conductive material, intimately encompassing the tertiary winding in a geometric configuration wherein the leakage inductance between said tertiary and said secondary windings is minimized and wherein the high-pot breakdown between said primary and secondary windings is at least 3750 VAC.

2. A transformer suitable for VHF power conversion applications comprising:

a magnetizable material core assembly;

a telescoping bobbin assembly mountable on a pole portion of the core assembly, said bobbin assembly having inner and outer sections telescoping together and forming an interior clearance space between said sections an isolated conduit from said isolated clearance space to the outside of.the bobbin assembly, said conduit being substantially parallel to the longitudinal axis of the bobbin assembly;

a first conductive lead coiled on the outer section said bobbin assembly to form a first inductive winding and having ends passing through exit ports in the outer section to said interior clearance space, said ends exiting from said bobbin assembly through said narrow isolated conduit, said ends being held isolated from the pole portion of the core assembly by said inner bobbin section; and a second conductive lead coiled on the outer section of the bobbin assembly to form a second inductive winding intimately encompassing said first inductive winding and held electrically isolated from said first winding and from the exiting leads of said first winding, wherein said first winding and said second winding are wound in physically intimate whereby the leakage inductance between said first and second windings is minimized and whereby the electrical high-pot breakdown said first and second windings is at least 3750 VAC.

3. A transformer according to claim 2 wherein said second inductive winding is formed from a continuous sheet of material having a geometry and spacing designed for minimizing the leakage inductance between said first and second winding.

4. A transformer according to claim 3 wherein said continuous sheet of material is copper.

5. A transformer according to claim 3 additionally comprising a conductive shield interposed between said first and said second windings, said shield completely covering said first winding and being electrically isolated from said first and said second windings.

6. A transformer according to claim 5 wherein said conductive shield is copper.

7. A transformer according to claim 5 additionally comprising a third conductive lead coiled on the inner section of said bobbin assembly to form a third inductive winding, said third winding having ends passing through said interior clearance space and exiting from said bobbin assembly through said narrow conduit.

8. A transformer according to claim 7 additionally comprising a fourth conductive lead coiled on the outer section of the bobbin assembly to form a fourth conductive winding interposed between said conductive shield and said second inductive winding, said fourth inductive winding having a geometry and spacing for minimizing the leakage inductance between said first and fourth inductive windings.

9. A transformer according to claim 8 additionally comprising rectifying means connected to said second winding for rectifying the output of said second winding whereby the inductance between said rectifying means and said second winding is minimized.

10. A transformer according to claim 9 wherein said rectifying means includes at least two Schottky diodes with electrically common cathode terminals and with anode terminals connected to ends of said second winding.

11. A transformer according to claim 10 wherein said magnetizatible material core assembly is a pot-type core.

12. A transformer according to claim 10 wherein said magnetizable material core assembly is an E-type core.

13. A transformer according to claim 1 wherein said first conductive lead is made from Litz wire.

14. A transformer according to claim 1 wherein said multi-turn tertiary winding is a dual parallel-wound winding.

15. A transformer according to claim 1 additionally comprising a capacitor electrically connected to the ends of said tertiary winding whereby the inductance between said tertiary and said capacitor is minimized.

16. A transformer according to claim 1 wherein said inner bobbin section has a lead slot providing an exit passageway for an end of said primary winding remote from the end of the bobbin assembly having said isolated conduit.

17. A transformer according to claim 1 wherein said magnetizable material core assembly is an E-type core.

* * * * *

UNITED STATES PATENT AND TRADEMARK OFFICE

CERTIFICATE OF CORRECTION

PATENT NO. : 4,549,130

DATED : October 22, 1985

INVENTOR(S) : E. A. Dobberstein

It is certified that error appears in the above-identified patent and that said Letters Patent is hereby corrected as shown below:

Claim 2
Col. 12, line 26 "intimate whereby" should be --intimate relation whereby--.

Signed and Sealed this

*Twenty-third* Day of *September 1986*

[SEAL]

*Attest:*

DONALD J. QUIGG

*Attesting Officer* *Commissioner of Patents and Trademarks*